United States Patent [19]

Mittag

[11] 4,041,646

[45] Aug. 16, 1977

[54] GATE

[75] Inventor: Douglas C. Mittag, Bolingbrook, Ill.

[73] Assignee: Aurora Equipment Company, Aurora, Ill.

[21] Appl. No.: 634,503

[22] Filed: Nov. 24, 1975

[51] Int. Cl.[2] ..... E05D 7/00

[52] U.S. Cl. ..... 49/385; 182/112; 49/49

[58] Field of Search ..... 49/385, 366, 49; 182/112, 113

[56] References Cited

U.S. PATENT DOCUMENTS

| | | | |
|---|---|---|---|
| 1,435,079 | 11/1922 | Porter | 49/385 |
| 3,188,759 | 6/1965 | Lowrey | 49/385 |

FOREIGN PATENT DOCUMENTS

| | | | |
|---|---|---|---|
| 411,992 | 4/1910 | France | 49/385 |

*Primary Examiner*—Kenneth Downey
*Attorney, Agent, or Firm*—Hill, Gross, Simpson, Van Santen, Steadman, Chiara & Simpson

[57] ABSTRACT

A rotatable gate floor entrance has one or two gates which are pivotably attached at a lower corner to a post structure connected to a floor. The gate or gates rotate in a vertical plane from an open to a closed position. When a single gate is used, a gate lock connects the gate to a second vertical post. When two gates are used, the first gate is rotatably connected at a lower corner to a first post support and the second gate is attached in similar fashion to a second vertical post. Both the first and second gates rotate in a vertical plane and, when placed in a closed position, have side edges which abut one another. The two gates are locked in this position by upper and lower channel members mounted to the gates.

7 Claims, 9 Drawing Figures

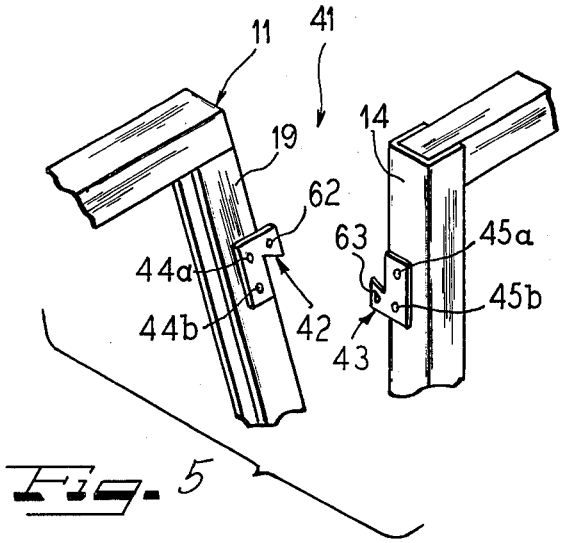
Fig. 5
Fig. 6
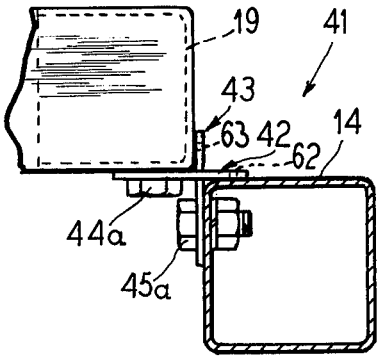
Fig. 7
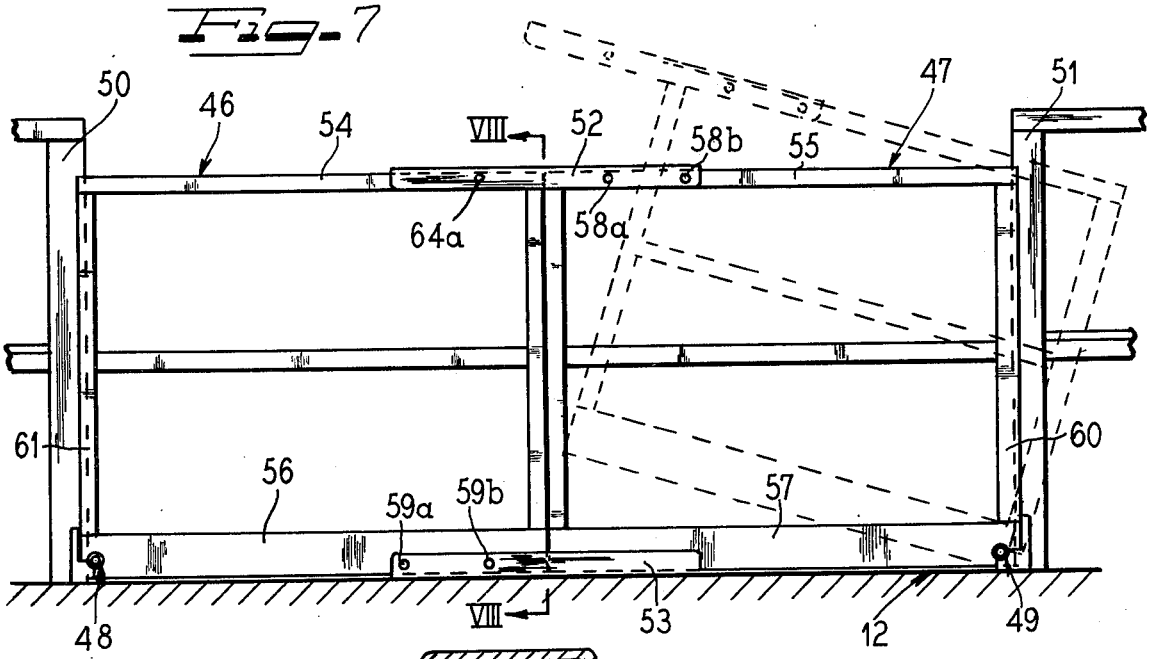
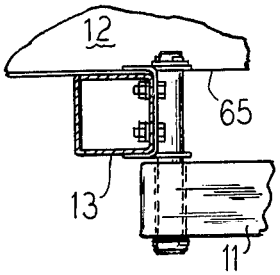
Fig. 9
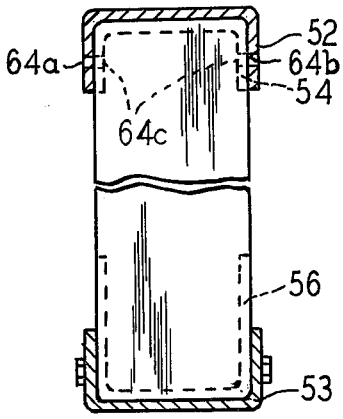
Fig. 8

GATE

BACKGROUND OF THE INVENTION

1. Field of the Invention

This invention relates to a rotatable gate for a floor entrance.

2. Prior Art

Previously, an entranceway to a raised or ground level floor such as a large storage rack pallet or raised walkway was blocked off with chains or a removable railing system. Gates which swing horizontally would be inconvenient for closing an entrance to a floor since a swing area would have to be provided which would result in wasted space.

SUMMARY OF THE INVENTION

A rotatable gate for a floor entrance is provided which is a simple design and does not require any swing room. Furthermore, the rotatable gate of this invention affords greater protection to persons on a raised floor near an entranceway as compared with the use of chains, slidable railings, or other makeshift devices.

In one embodiment of this invention, a rotatable gate for a floor entrance comprises first and second gate support means connected to a floor. A rotatable gate having first and second side edges is positioned between the support means. A hinge means connects the first side edge of the rotatable gate means to the gate support means such that the gate means will rotate in a substantially vertical plane about the hinge means. A locking means is provided to connect the second side edge of the rotatable gate means to the second gate support means. By simply lifting one end of the rotatable gate, the gate may be swung open in a vertical plane until the first side edge of the gate abuts the floor. In the closed position, a locking means together with the hinge means provide resistance to any horizontal forces such as a worker brushing against the entranceway.

In another embodiment of this invention, first and second gate support means are vertically mounted to a floor. First and second rotatable gates, which are aligned in a common vertical plane with respect to the floor, are hinged by first and second hinge means to the first and second gate support means, respectively. To close the gates, the first and second gate means rotate in a substantially vertical plane toward one another until side edges of the two gates abut. A locking means comprising an upper channel section connected to the first gate means and a lower channel section connected to the second gate means cause the two gates to interlock with one another. This locking means not only maintains a closed position but also provides horizontal rigidity to the gates.

It is an object of this invention to provide single or dual gates for a entranceway to a floor which are simple to manufacture and to install.

It is a further object of this invention to provide a rotatable gate or gates which are hinged to rotate in a vertical plane and therefore do not require a horizontal swing area.

It is another object of this invention to provide rotatable gate or gates which, in the closed position, will resist horizontal forces to provide protection for persons walking near the entrance of a raised floor.

On the drawings:

FIG. 5 is a perspective view of a locking mechanism used with the rotatable gate of this invention;

FIG. 6 is a top cross-sectional view of the locking mechanism of FIG. 5 with the rotatable gate of this invention in a closed position;

FIG. 7 is a side view of dual rotatable gates for a floor entrance;

FIG. 8 is an end view taken along line VIII—VIII of FIG. 7 illustrating a latching mechanism for the dual rotatable gates of this invention; and FIG. 9 is a fragmentary top view of an alternate embodiment of the hinge mechanism and rotatable gate alignment shown in FIG. 2.

As shown on the drawings:

Figure 1:
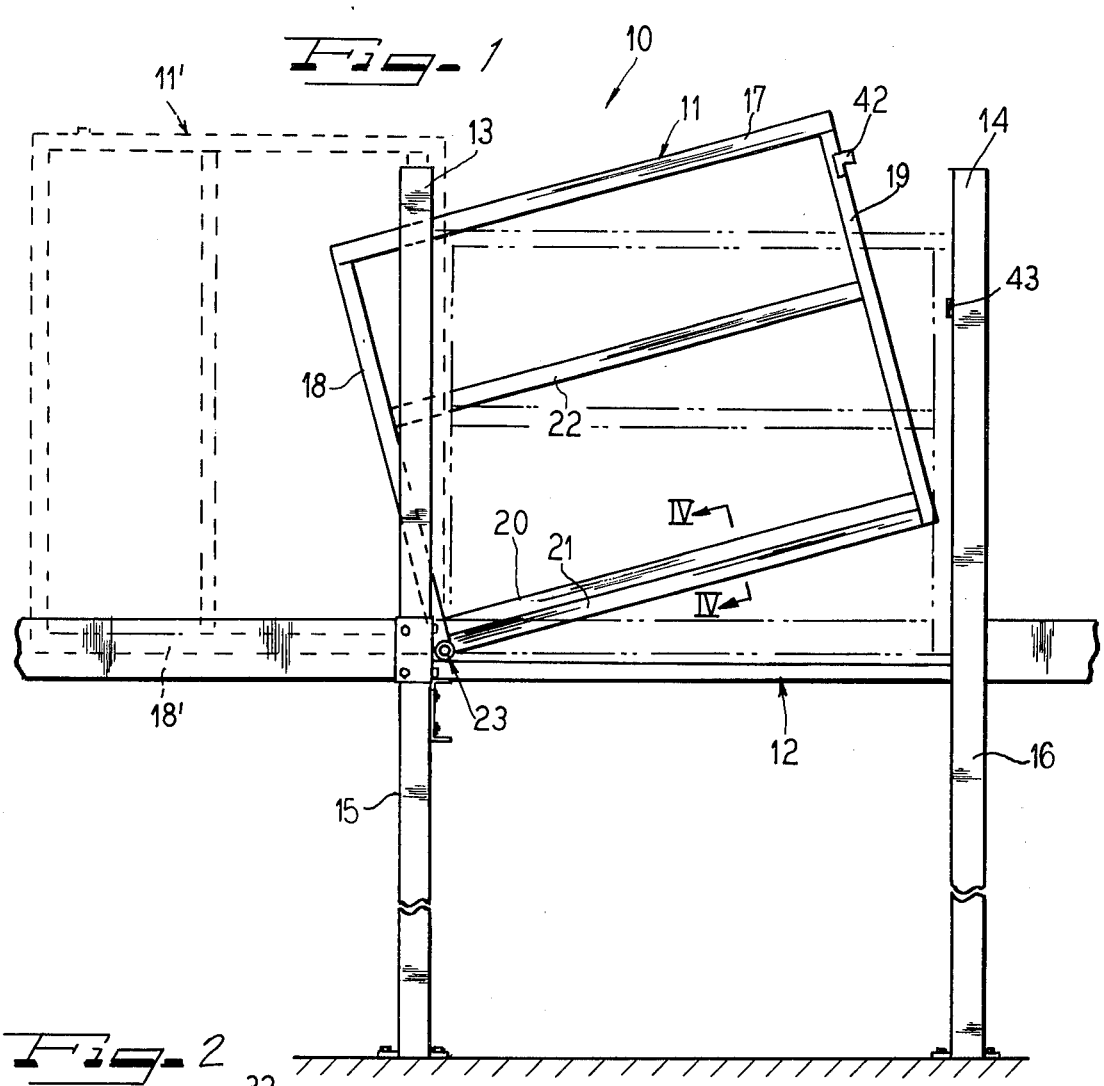
FIG. 1 is a side view of a rotatable gate of this invention as used at a raised floor entrance.

The principles of the present invention are particularly useful when embodied in a rotatable gate for a raised floor entrance as shown in FIG. 1, generally indicated by the numeral 10. It should be understood, however, that the rotatable gate of this invention is also useful as an entranceway to a ground level floor.

A rotatable gate 11 is hingably connected to a gate support structure comprising a floor 12, first support 13, and second support 14. The floor 12 is raised from ground level by first and second floor supports 15 and 16. The first and second supports 13 and 14 comprise vertically aligned posts which are continuations of the first and second floor supports 15 and 16, respectively. It should be obvious, however, that the supports 13 and 14 may be directly embedded in the floor 12.

The floor 12 may be constructed from steel, wood, or any other flooring material. In the preferred embodiment, the floor 12 functions as a pallet drop area on a storage rack or shelf but could also be a walkway in a factory, mezzanine, or the ground level or second floor in a home or other building. Although no steps are shown, access to the raised floor entranceway may be provided with permanent steps or moveable ladders.

The floor supports 15 and 16 and the first and second supports 13 and 14 may be constructed of I beams, wood, metal channel sections having a hollow interior, solid metal sections, or the like. The rotatable gate 11 is preferably constructed of steel channel sections.

The rotatable gate 11 is preferably formed as a rectangle bounded by a railing 17, first and second side members 18 and 19 joined at right angles to the railing 17, abutting cross pieces as bottom members 20, 21 joined at right angles to the first and second side members 18 and 19, and a cross member 22 connected between the first and second side members 18 and 19 between and parallel to the railing 17 and bottom members 20, 21. The abutting bottom members 20, 21 function as a kick plate or toe board to warn persons walking along a raised floor that they have strayed too close to the edge of the floor 12. Also, this plate prevents items from passing under the gate.

Figure 2:
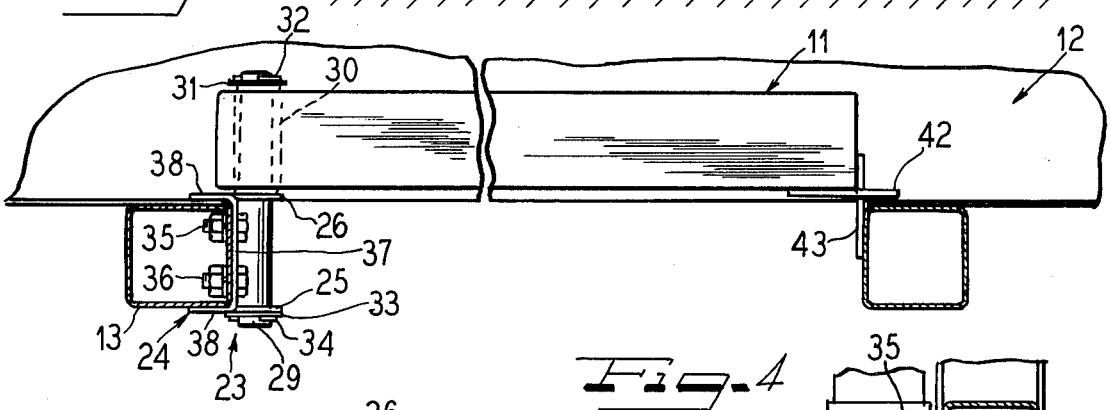
FIG. 2 is a fragmentary bottom view of the rotatable gate and hinge structure of this invention.
Figure 3:
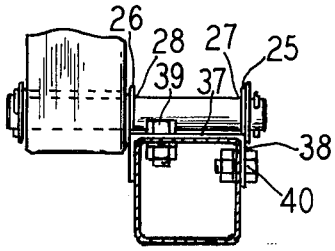
FIG. 3 is a fragmentary bottom view of an alternate embodiment of the hinge structure for a rotatable gate of this invention.
Figure 4:
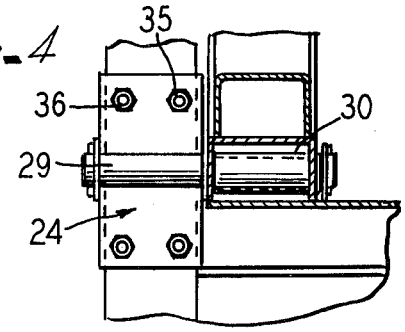
FIG. 4 is a fragmentary cross-sectional view taken along line IV—IV of FIG. 1 illustrating the hinge structure of the rotatable gate of this invention.

Referring now to FIGS. 2, 3, and 4, the hinge structure 23 is shown which connects the rotatable gate 11 to the first support 13. A U-shaped hinge bracket 24 engages the outer periphery of first support 13. First and second flanges 25 and 26, having respective apertures 27 and 28, are provided at approximately the midpoint of the U-shaped hinge 24. A sleeve pipe 30 is welded to a lower end of the first side member 18 of the rotatable gate 11 near the junction with the bottom members 20, 21. Although a sleeve pipe 30 is used in the preferred embodiment of this invention, it is obvious that as an alternative, a bore could be provided through the lower corner of the gate 11. A pivot pin 29 is engaged in and aligns the sleeve pipe 30 with the first and second flanges 25 and 26. A first washer 21 is locked to the sleeve pipe 20 adjacent an outer edge of the bottom member 20, 21 by a cotter pin 32 inserted in one end of the pivot pin 29. A second washer 33 is slidably engaged over the other end of the pivot pin 29 adjacent an outer edge of the first flange 25 on the hinge bracket 24. A second cotter pin 34 inserted in the end of the pivot pin 29 locks the second washer 33 and pivot pin 29 in place.

The U-shaped hinge bracket 24 is secured to the first support 13 by first and second mounting bolts 35 and 36 positioned in apertures within a front portion 37 of the U-shaped bracket 24. In an alternate embodiment illustrated in FIG. 3, a first bolt 39 is positioned through the front portion 37 while a second bolt 40 is provided in the outer side wing 38 of the U-shaped bracket 24.

Referring now to FIGS. 5 and 6, a latching mechanism 41 is illustrated. Although only one such mechanism is shown in FIG. 1, a plurality of latching mechanisms 41 may be provided in vertical alignment along first side member 18 and first support 13.

The latching mechanism 41 comprises a downwardly notched hook member 42 attached to the side of second side member 19 by two bolts 44*a*, 44*b*. An upwardly notched hook member 43 is attached to an inside surface of second support 14 by two bolts 45*a*, 45*b*. The downwardly and upwardly notched hook members 42 and 43 are bolted to the rotatable gate 11 and second support 14 at the correct height to permit the two hook members to interlock with one another as clearly illustrated in FIG. 6. Apertures 62 and 63 are respectively provided in hook members 42 and 43 for insertion of a locking device, not shown, such as a padlock hasp or a chain.

Referring now to FIG. 7, another embodiment of this invention is illustrated in which two, rather than one, rotatable gates are employed. The first rotatable gate 46 and the second rotatable gate 47 are aligned in a common vertical plane to a first support 50 and second support 51, respectively. The first and second rotatable gates 46 and 47 are similar in design to the embodiment illustrated in FIG. 1. First and second hinge structures 48 and 49 pivotably connect the two gates to first and second supports 50 and 51, respectively in a fashion previously described in reference to FIG. 1. However, a different locking mechanism is employed for the two gate embodiment as opposed to the gate latching mechanism 41 of FIGS. 5 and 6. A top locking channel 52, having a U-shaped cross-section, has one end engaged with and bolted to a second railing 55 on a second rotatable gate 47. Two bolts, 58*a* and 58*b* secure the top locking channel 52 in place. A bottom locking channel 53, also having a U-shaped cross-section, has one end engaged with the bottom edge of a first bottom member 56 on first rotatable gate 46. Bolts 59*a*, 59*b* secure the bottom locking channel 53 in position. In a closed position, the second bottom member 57 on the second rotatable gate 47 slides into the bottom locking channel 53. In similar fashion, a first railing 54 on the first rotatable gate 46 slides into the top locking channel protruding from the second rotatable gate 47. FIG. 8 clearly illustrates the close fitting engagement of the railing and bottom members in their locking channels.

Aligned apertures 64*a* and 64*b* are provided opposite one another on the side flanges of the top locking channel 52 in a portion of the channel remote from the bolts 58*a*, *b*. Another aperture 64*c* in first railing 54 aligns with apertures 64*a*, 64*b* when the gates 46 and 47 are in a locked position. A locking device, such as a padlock hasp or chain, may be inserted through apertures 64*a*, 64*b*, and 64*c* to lock the gates.

Operation of the rotatable gate or gates for a raised or ground level floor entrance will now be described. With reference to FIG. 1, the rotatable gate 11 is shown in a fully open position 11′ and a partially closed position 11. In the open position, the first side member 18′ abuts the surface of the floor 12. To close the gate, an operator rotates the gate about the hinge structure 23 in a vertical plane until the bottom members 20, 21 approach the floor 12. At this point, the downwardly notched hook member 42 engages the upwardly notched hook member 43 to stop further rotation of the gate 11. Resistance to horizontal forces applied to the gate 11, such as a person actually bumping the gate while walking on the floor 12, is provided by the hinge structure 23 at one lower corner of the gate 11 and by downwardly notched hook member 42 having an end which abuts against the side of second support 14 as shown most clearly in FIG. 6. Also, as illustrated in FIG. 2, a portion of the second side member 18 overlaps with the side of the first support 13 such that any horizontal force exerted on the gate 11 from the floor side of the gate 11 will cause the first side member 18 to bump against the first support 13.

It should be obvious that the gate 11 may be slightly longer such that the second side member 19 overlaps with the inside surface of second support 14 to provide increased resistance to horizontal forces imparted to the gate from the inside of the entranceway. In such a case, the latching mechanism 41 could be modified to provide clearance between the second support 14 and second side member 19.

Referring now to FIG. 7, the operation of the dual gate floor entranceway will be described. In an open position, first and second rotatable gates 46 and 47 are in a rotated position such that side members 60 and 61 abut the surface of floor 12. To close the gates, first rotatable gate 46 is rotated by approximately 90° in a vertical plane about the first hinge structure 48 until the first bottom member 56 abuts the floor 12. Thereafter, second rotatable gate 47 is rotated in towards the first gate 46 until second bottom member 57 is slidably received in the end portion of the bottom locking channel 53. Simultaneously, the end portion of the top locking channel 52 slips over the first railing 54 of the first rotatable gate 46. With the gates in the closed position, top and bottom locking channels 52 and 53 resist horizontal forces directed against the gates from either the inside or outside of the entranceway.

When the gate or gates of this invention are mounted to posts on a raised floor, the gates may also be attached on the outside of supporting posts to allow the gates to clear the edge 65 of the raised floor 12 as shown in FIG. 9. Therefore, in an open position, the gate 11 may swing down below the floor level.

The rotatable gate or gates of this invention provide a guarded entranceway for a raised pallet on storage shelving or a catwalk. However, this invention is also useful as a guard gate for any other raised or ground level floor.

Although various minor modifications may be suggested by those versed in the art, it should be understood that I wish to embody within the scope of the patent warranted hereon all such embodiments as reasonably and properly come within the scope of my contribution to the art.

I claim as my invention:

1. A rotatable gate structure for a raised walkway entrance, comprising:

a. a raised walkway supported by a plurality of vertical support posts;

b. a railing alongside an edge of said walkway;

c. an entrance to said raised walkway at said edge defined by upward extensions of first and second of said vertical support posts which also define ends of the railing on each side of the entrance;

d. a rectangular vertically rotatable gate having first and second side members;

e. a hinge structure for vertical rotation of said gate connecting a lower corner of said gate to the upward extension of the first vertical post adjacent a surface of the walkway, the hinge structure positioning the gate such that the first side member of the gate is spaced inwardly towards the walkway from the first vertical post so that vertical rotation of the gate occurs alongside the first vertical post; and f. locking means connecting said second side member of the rotatable gate to the upward extension of said second post for locking the gate and supporting the second side member of the gate against horizontal forces directed toward the edge of the walkway.

2. A rotatable gate structure of claim 1 in which said hinge structure is positioned to permit a bottom edge of the gate to abut said walkway when said gate is in a closed position and such that the first side member of the gate overlaps the upward extension of the first post.

3. A rotatable gate structure of claim 1 in which said locking means comprises a downwardly notched hook member attached to said second side member of said gate and which abuts a side edge of the upward extension of the second vertical post to resist a horizontal force, and an upwardly notched hook member attached to the upward extension of the second vertical post at a right angle to and at a same height as said downwardly notched hook member when said gate is in a closed position.

4. A rotatable gate structure of claim 2 in which said hinge structure comprises a sleeve pipe mounted at a lower corner of the gate, a hinge bracket mounted on said upward extension of the first vertical post, and a pivot pin retaining said sleeve pipe in alignment with said hinge bracket.

5. A rotatable gate structure for a raised walkway entrance, comprising:

a. a raised walkway supported by a plurality of vertical support posts;

b. a railing alongside an edge of said walkway;

c. an entrance to said raised walkway at said edge defined by upward extensions of first and second of said vertical support posts which also define ends of the railing on both sides of the entrance;

d. two rectangular, vertically rotatable gates each having first and second side members;

e. first and second hinge structures for vertical rotation of each of said gates, the first hinge structure connecting a lower corner of the first gate to the upward extension of the first vertical post adjacent a surface of the walkway, the second hinge structure connecting a lower corner of the second gate to the upward extension of the second vertical post adjacent the surface of the walkway, the first and second hinge structures positioning the first and second gates such that the first side members of the first and second gates are spaced inwardly towards the walkway from the first and second vertical posts so that vertical rotation of the gates occurs alongside the first and second vertical posts; and f. locking means connecting said second side members of said first and second gates to each other when said first and second gates are in a closed position; whereby the entrance to the walkway is closed by rotating the first and second gates toward each other in a vertical plane.

6. A rotatable gate structure of claim 5 in which said locking means comprises an upper channel section having one end connected to a top edge of said second rotatable gate and the other end having a downwardly facing open channel, and a lower channel section having one end connected to a bottom edge of said first rotatable gate and the other end having an upwardly facing open channel, said downwardly facing channel receiving an upper edge of said first rotatable gate and said upwardly facing channel receiving a bottom edge of said second rotatable gate.

7. The rotatable gate structure of claim 5 in which the first side members of the first and second gates respectively overlap the upward extensions of the first and second posts.

* * * * *